US005393256A

United States Patent [19]

Mitchell et al.

[11] Patent Number: 5,393,256

[45] Date of Patent: Feb. 28, 1995

[54] FLYING BUBBLE-PRODUCING TOY AND METHOD

[75] Inventors: Richard Mitchell; Lorin Smith; Robert Hopkins, all of Provo, Utah

[73] Assignee: M.R.L. Manufacturing, Inc., Provo, Utah

[21] Appl. No.: 192,444

[22] Filed: Feb. 7, 1994

[51] Int. Cl.[6] ..... A63H 33/28; A63H 27/00

[52] U.S. Cl. ..... 446/15; 446/48

[58] Field of Search ..... 446/15, 20, 21, 46, 446/48, 236, 267, 475, 483

[56] References Cited

U.S. PATENT DOCUMENTS

| | | | |
|---|---|---|---|
| 1,397,162 | 11/1921 | Dobbins | 441/20 |
| 2,739,413 | 3/1956 | Peretti | 446/20 |
| 3,002,314 | 10/1961 | Brottman . | |
| 3,008,263 | 11/1961 | Ellman . | |
| 3,600,842 | 8/1971 | Bryman . | |
| 4,157,632 | 6/1979 | Everett . | |
| 4,184,284 | 1/1980 | Rogahn | 446/48 X |
| 5,041,042 | 8/1991 | Stein | 446/15 |
| 5,078,636 | 1/1992 | Clark et al. | 446/20 X |
| 5,080,623 | 1/1992 | Stein | 446/15 |
| 5,102,381 | 4/1992 | Danielak et al. | 446/15 X |
| 5,181,875 | 1/1993 | Hasegawa | 446/15 |
| 5,277,641 | 1/1994 | Gable et al. | 446/48 X |

FOREIGN PATENT DOCUMENTS

| | | | |
|---|---|---|---|
| 2316497 | 4/1974 | Germany | 446/15 |

*Primary Examiner*—Robert A. Hafer
*Assistant Examiner*—D. Neal Muir
*Attorney, Agent, or Firm*—Thorpe, North & Western

[57] ABSTRACT

A rotational glider toy configured for producing bubbles during free flight. The toy includes a circular disc body having a plurality of bubble-forming apertures formed therein. A reservoir structure is coupled to a lower surface of the body and encloses a storage area. The reservoir structure includes a plurality of solution feed holes formed in a junction between the reservoir structure and the lower surface, said solution feed holes being in communication with the storage area. Bubble solution is inserted into the storage area through a capped filling hole therein. Centrifugal force during rotational movement of the toy operates to urge the bubble solution out of the feed holes such that it spreads onto the lower surface of the body and into the bubble-forming apertures. Air currents passing through the bubble-forming apertures cause the bubble solution to be released from the toy in a stream of bubbles.

17 Claims, 2 Drawing Sheets

FLYING BUBBLE-PRODUCING TOY AND METHOD

BACKGROUND OF THE INVENTION

1. The Field of the Invention

The present invention relates generally to flying amusement toys. More particularly, it concerns a flying toy capable of producing a stream of bubbles during free flight.

2. The Background Art

Rotational frisbee discs are well known in the field of flying toy devices, and are typically made of a single molded plastic disc. There are many other types of flying toys, a large number of which are capable of rotational flight. The prevalence of frisbees and other flying toys is readily apparent to anyone familiar with recreational sites such as parks and beaches. The rotational types of flying toys are launched into free flight by gripping and throwing the toy using an underhanded or sidearm motion with a snap of the wrist. The toy spins into rotational flight, and the direction, length and trajectory of the flight can be varied by the angle of release of the disc relative to the horizontal plane and by the force of the throwing motion.

Attempts have been made to provide rotational flying toys with soap solution and bubble-forming apparatus to cause the toy to produce bubbles during free flight. U.S. Pat. No. 3,600,842 (issued to Bryman on Aug. 24, 1971) illustrates an airfoil glider toy having a bubble ring coaxially disposed in the center thereof. A user dips the bubble ring into a saponaceous solution and launches the toy into free flight. As the toy progresses in flight, the saponaceous solution is released from the bubble ring in the form of a stream of bubbles.

A dip method of supplying bubble solution to a flying, bubble-producing toy is also illustrated in U.S. Pat. No. 5,041,042 (issued to Stein on Aug. 20, 1991). Therein is described a planar, skeletal open framework, including several bubble-forming apertures. A user dips the apertures in a soapy solution and launches the toy into free flight to cause the toy to produce bubbles.

U.S. Pat. No. 4,157,632 (issued to Everett on Jun. 12, 1979) illustrates a flying disc toy having self-contained storage capacity for storing bubble solution. A concave lower surface of a flying disc includes a downwardly-arching hollow tube disposed thereon, the tube including a filler hole and terminating at a lower end in a dispersing screen. A user fills the tube with bubble fluid and launches the toy into flight. During the flight, the soap solution drains out of the hollow tube and onto the dispersing screen. Air currents passing through the dispersing screen force the bubble fluid out of the screen in the form of bubbles.

A flying toy with a bubble solution storage unit is also illustrated in U.S. Pat. No. 4,184,284 (issued to Rogahn on Jan. 22, 1980). An open, hollow circular projection extends from a top surface of a flying disc toy wherein bubble solution is stored. A round, inverted cup member is placed over the circular projection and is slidably engaged therewith. Aerodynamic blades extend radially outward from the rotational cup member and operate to catch the air after the toy is launched into free flight. The blades thereby cause the cup member to lift and separate from the toy, allowing the bubble solution to flow out of the open top of the circular projection and spread over an upper surface of the toy. Bubbles are formed when the solution reaches bubble-producing apertures formed in the toy.

The collective approaches in the prior art field of bubble-producing flying toys have a number of disadvantages. The flying toys which receive bubble solution by dipping have negligible storage capacity. Bubble solution must be repeatably and often supplied in order to maintain bubble-producing capacity for a plurality of flights, causing inconvenience to the user. The lack of storage capacity also results in fewer bubbles during flight, and the small amount of bubble solution retained can become entirely exhausted during a long flight.

Some of the flying toys which actually provide storage for bubble solution are limited to extremely small storage structure, as in the storage tube of the U.S. Pat. No. '632 patent to Everett. The flying toys which provide a larger amount of storage require complex and expensive structure, as in the U.S. Pat. No. '284 patent to Rogahn. Further, the Rogahn toy fails to provide for a slow release of bubble solution—the solution is thrown quickly by centrifugal force from a large opening and spreads across the top surface of the toy. The solution is thereby released much quicker than necessary to make bubbles, and causes a sticky film of bubble solution to collect over the top surface of the toy which sticks to the hands of the user during use. The user must either tolerate this inconvenience or wash his or her hands between throws of the toy.

It is also difficult to retain the bubble solution in prior art storage structures. The bubble solution will drain out if the toy lands upside down (U.S. Pat. No. '284 patent to Rogahn), or if the toy is not thrown shortly after inserting bubble solution therein (U.S. Pat. No. '632 patent to Everett).

OBJECTS AND SUMMARY OF THE INVENTION

It is therefore an object of the present invention to provide a flying bubble-producing toy which is inexpensive to make, and easy and convenient to use.

It is an additional object of the invention to provide such a toy which is simple in design and structure.

It is another object of the invention to provide such a toy which is capable of storing enough bubble solution therein for use during a plurality of flights.

It is a further object of the invention to provide such a toy which retains stored bubble solution therein regardless of when thrown.

It is an additional object of the invention to provide such a toy which provides a slower release of stored bubble solution and preserves the bubble solution for an increased number of throws.

It is another object of the invention, in accordance with one aspect thereof, to provide such a toy which produces airstreams to thereby enhance and increase the production of bubbles.

It is still another object of the invention, in accordance with one aspect thereof, to provide such a toy which dispenses stored bubble solution across a lower surface of the toy during free flight thereof.

It is yet another object of the invention, in accordance with one aspect thereof, to provide such a toy which retains at least a portion of stored bubble solution therein if turned upside-down.

The above objects and others not specifically recited are realized in a specific illustrative embodiment of a rotational glider toy configured for producing bubbles during free flight. The toy includes a circular disc body having a plurality of bubble-forming apertures formed therein. A reservoir structure is coupled to a lower surface of the body and encloses a storage area. The reservoir structure includes a plurality of solution feed holes formed in a junction between the reservoir structure and the lower surface. The solution feed holes are in communication with the storage area. Bubble solution is inserted into the storage area through a capped filling hole therein. Centrifugal force during rotational movement of the toy operates to urge the bubble solution out of the feed holes such that it spreads onto the lower surface of the body and into the bubble-forming apertures. Air currents passing through the bubble-forming apertures cause the bubble solution to be released from the toy in the form of bubbles.

It will be appreciated that the present invention includes a larger storage capacity and operates to distribute bubble solution over a continuous surface area. The prior art attempts to achieve these objectives but have been unable to avoid the disadvantages of clumping of solution. For example, in the Rogahn toy, the bubble solution splashes unrestrained across the upper surface of a continuous plate-like body such that large amounts of bubble solution are exposed to the ambient, rushing air. Consequently, there is a tendency for bubbles to adhere to the continuous upper surface and slide against each other, finally dropping off of the toy in clumps of foam. Although the U.S. Pat. No. '632 patent to Everett avoids this problem, it does so with a separate tube attached to the lower surface of the toy, the tube having minimal storage capacity.

It is doubtful that anyone has considered making a toy which distributes bubble solution uncontained across the lower surface of the toy. Not only would this be inconsistent with tradition, but it appears impractical to distribute bubble solution across a smooth lower surface without some or all of the solution dripping from the toy before reaching the bubble-formation stage. Indeed, it is not readily apparent that one could solve the problems of clumping, dripping and excessive application of solution by somehow conveying bubble solution uncontained across the lower surface of the toy. However, applicant has invented a toy with a unique storage reservoir structure which achieves these very objectives. When this unique storage reservoir is applied to the lower surface of the toy, the bubble solution is distributed uncontained onto and across the lower surface in a unique way which substantially prevents the solution from dripping, clumping or being applied excessively. The unique storage reservoir can also be applied to the upper surface to distribute bubble solution thereon without the disadvantages of the prior art.

Additional objects and advantages of the invention will be set forth in the description which follows, and in part will be apparent from the description, or may be learned by the practice of the invention. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawing in which.

DETAILED DESCRIPTION OF PRESENTLY PREFERRED EMBODIMENTS

Figure 1:
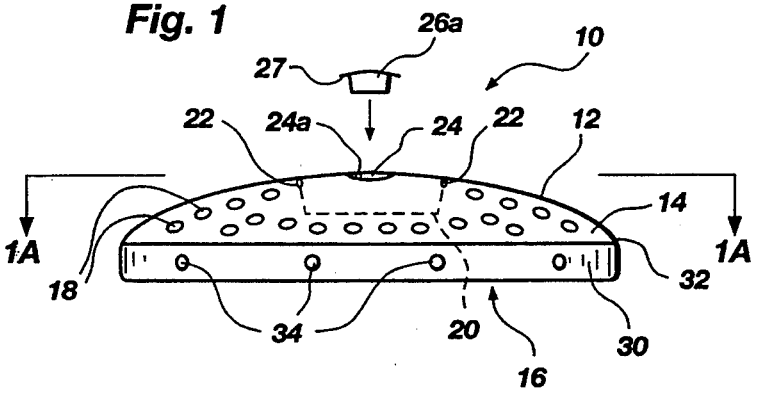
FIG. 1 illustrates a perspective view of a flying bubble-producing toy made in accordance with the principles of the present invention.

Reference will now be made to the drawings wherein like structures will be provided with like reference numerals.

Figure 1A:
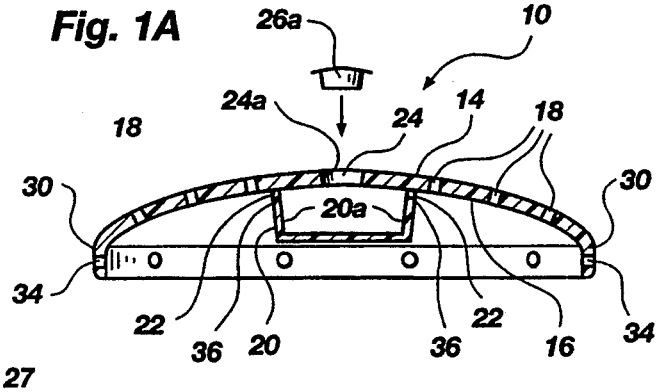
FIG. 1A illustrates a side, cross-sectional view of the flying bubble-producing toy shown in FIG. 1, taken along section A—A.

Referring now to FIGS. 1 and 1A, there is shown an embodiment of a flying bubble-producing toy, generally designated at 10. The toy 10 includes a thin, plate-like body 12 in FIG. 1, having upper and lower surfaces 14 and 16, respectively. One or more bubble-forming apertures 18 are formed in the body 12. A reservoir 20 is coupled to the lower surface 16 and includes one or more bubble-solution feed holes 22 formed in a junction/corner 36 (FIG. 1A) between the reservoir 20 and the lower surface 16. The reservoir 20 is hollow and encloses a storage area, and the solution feed holes 22 are in communication with said storage area. A filling hole 24 is formed in an upper portion of the reservoir 20. A removable plug **26*a* is configured for frictional engagement with defining edges 24*a* of the filling hole 24 to thereby substantially close off said filling hole 24. A stopping flange 27 prevents the plug 26*a* from falling completely through the filling hole 24 and into the reservoir 20. A surrounding rim 30 extends outward from a perimeter 32 of the body 12. One or more air feed holes 34 are formed in the surrounding rim 30**.

A user operates the toy 10 by inserting bubble solution (not shown) as known in the art through the filling hole 24 and into the reservoir 20. The user grasps the surrounding rim 30 and an adjacent portion of the body 12 in one hand. A portion of the upper surface 14 of the body 12 may be textured to make the toy 10 easier to grip. However, it is preferred that the upper and lower surfaces 14 and 16 be substantially smooth, since ridges and the like tend to propel stray bubble solution, if any, from the toy 10.

The user launches the toy 10 into rotational, gliding free flight in any desirable manner, preferably with a snap of the wrist as known to those familiar with throwing frisbees and the like. As the toy 10 rotates, centrifugal forces are produced therein which are directed radially outward from an axis of rotation of the toy 10. The centrifugal forces cause the bubble solution (not shown) to swirl against walls **20*a* of the reservoir 20, which preferably define a conical section tapering outwardly toward the solution feed holes 22 as shown most clearly in FIG. 1A. The centrifugal forces and the outwardly-tapered conical walls 20***a* co-act to urge the bubble solution through the solution feed holes 22, across the lower surface 16 of the body 12, and into the bubble-forming apertures 18. It will be appreciated that the configuration of the toy 10 is unique in that centrifugal force is used in combination with distribution of bubble solution from the feed holes 22 which are positioned to adjoin the lower surface 16. This configuration enables bubble solution to be conveyed across the lower surface 16 substantially without dripping or clumping of bubble solution.

Air currents (not shown) pass through the bubble-forming apertures 18 during free flight of the toy 10 and operate to form bubbles from the solution contained in said bubble-forming apertures 18. During free flight, the bubble solution is continuously fed from the reservoir 20 into the bubble-forming apertures 18, and the air currents are continuously passing through said apertures 18. The result is a plurality of bubble streams flowing from the bubble-forming apertures 18 throughout substantially the entire flight. It will be appreciated that the body 12 can be of any shape or configuration suitable for producing bubbles in the manner described. It is, however, preferable that the body 12 be a substantially rigid, concavo-convex member as shown in the figures, to thereby enable air to pass through the bubble-forming apertures 18 regardless of whether the toy is rising or falling.

Figure 5:
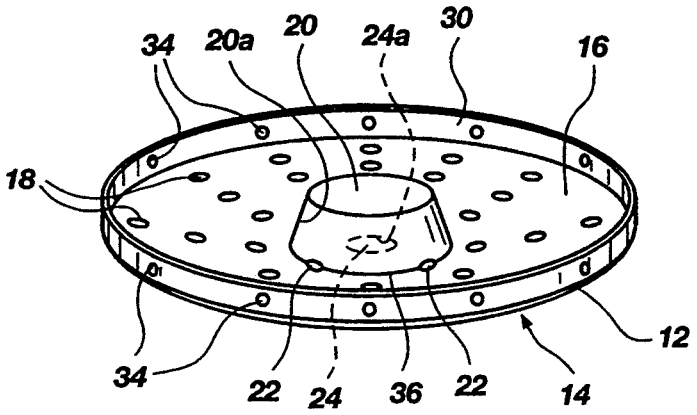
FIG. 5 illustrates a perspective view of the flying bubble-producing toy of FIG. 1, in an upside-down orientation.

Although the solution feed holes 22 can be formed anywhere in the reservoir 20, they are preferably formed in the junction/corner 36 between the reservoir 20 and the lower surface 16 of the body 12, as shown most clearly in FIGS. 1A and 5. This enables the solution to travel from the reservoir 20 directly onto the lower surface 16 to thereby enable centrifugal forces to retain the bubble solution on the lower surface 16 in an uncontained, uncovered condition without dripping off of the toy 10. Applicant has discovered that when the solution feed holes 22 are formed in the walls 20*a* away from the junction/corner 36, the further said holes 22 are from the junction/corner 36 the less the bubble solution is transferred onto the lower surface 16. The reservoir 20 is preferably circular, resulting in the junction/corner 36 being a corner circle, as shown most clearly in FIG. 5.

The toy 10 shown in FIG. 1 and 1A can be used with or without the plug 26*a*. It is preferable that the frictional engagement between the plug 26*a* and the defining edges 24*a* of the filling hole 24 be sufficient to inhibit the escape of bubble solution from said filling hole 24. It will be appreciated that when the plug 26*a* is inserted into the filling hole 24, a partial vacuum is produced within the reservoir 26. The phrase "partial vacuum," as used herein, does not refer to a space entirely devoid of matter as in the classical definition of "vacuum". Rather, it refers to the quality of subatmospheric pressure; the pressure in the reservoir 20 is originally equal to the ambient atmospheric pressure, and must be overcome by some force sufficient to remove bubble solution from the reservoir 20 and thereby produce, at least temporarily, a subatmospheric pressure within the reservoir 20. One effect of the partial vacuum is to control the rate of release of bubble solution from the solution feed holes 22, as explained below.

It is important that the toy 10 be capable of producing plentiful, steady streams of large bubbles which are visible from a distance, to enhance the enjoyment of the user(s). It is also important that the bubble solution contained in the reservoir 20 be conserved and extended to as many throws of the toy 10 as possible, to reduce the frequency of refilling the reservoir 20. It will be appreciated by those skilled in the relevant physics that the aspect of partial vacuum, as defined herein, operates to slow the speed by which the bubble solution is urged through the solution feed holes 22. The combination of the partial vacuum effect with solution feed holes 22, when said holes are approximately 3/32 of an inch in diameter, operates to achieve an optimal rate of distribution of bubble solution. The rate achieved in this configuration is such that just enough bubble solution is fed through the holes 22 to produce large, plentiful streams of bubbles which are visible and enjoyable from a distance, without wasting or dripping bubble solution. The bubble solution is thus conserved by the partial vacuum effect to be useable for more throws of the toy 10.

It will be appreciated that the toy 10 will sometimes land upside down, i.e. with the upper surface 14 facing the ground. If the prior art devices known to applicant land upside down, the bubble solution will drain from the toy as noted above in The Background Art. However, an additional advantage to the partial vacuum effect in the present invention is that the bubble solution is substantially retained within the reservoir 20 if the toy 10 lands upside down or otherwise with the holes 22 positioned below a surface level of stored bubble solution.

Figure 4:
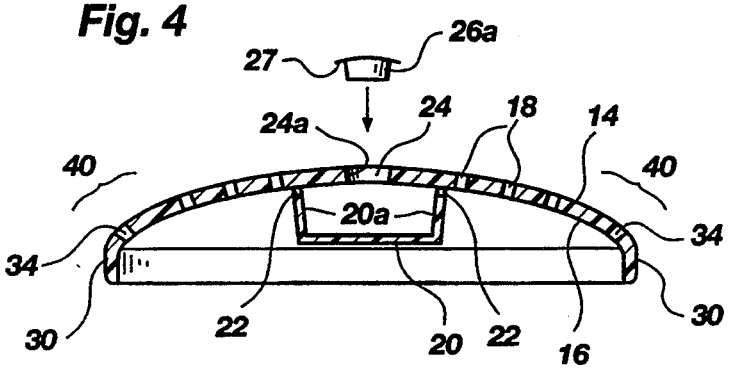
FIG. 4 illustrates a side, cross-sectional view of an alternative embodiment of the flying bubble-producing toy of FIGS. 1 and 1A, wherein the air-feed holes are formed in a leading edge of the toy instead of in a perimeter rim thereof.

A preferred embodiment includes a combination of the toy 10 illustrated in FIG. 1, modified in accordance with FIG. 4. The body 12 is preferably circular, but it is noted that the body 12 can have a central axis and an axis of rotation whether circular or some other shape. Applicant has found that substantial manufacturing costs can be saved if the air feed holes 34 are formed in a leading edge 40 (see FIG. 4) instead of in the surrounding rim 30. The toy performs in substantially the same manner whether the air feed holes 34 are formed in the surrounding rim 30 or in the leading edge 40. The toy 10 operates at maximum efficiency and bubble-producing capacity with at least eight evenly-spaced air feed holes 34 approximately $\frac{1}{4}$ of an inch in diameter, and with four solution feed holes 22 approximately 3/32 of an inch in diameter. It is preferable to space said four solution feed holes 22 evenly about the corner circle 36, such that approximately one quarter arc-length of the corner circle 36 separates each solution feed hole 22 from its adjacent solution feed holes.

Figure 1B:
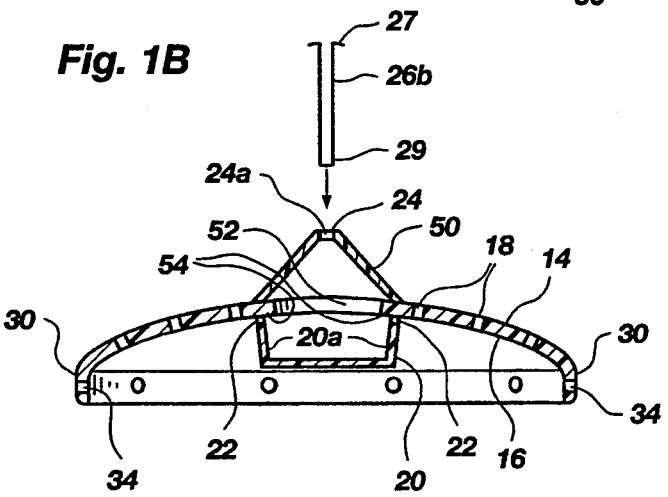
FIG. 1B illustrates a side, cross-sectional view of an alternative embodiment of the flying bubble-producing toy of FIGS. 1 and 1A, including an overflow chamber.

An additional aspect in accordance with the present invention includes an optional overflow chamber 50 as shown in FIG. 1B. The overflow chamber 50 substantially encloses an overflow area, and is preferably coupled to the upper surface 14 of the body 12 to be in communication through a passage 52 with the storage area enclosed by the reservoir 20. It is preferred that the filling hole 24 be formed in a top portion of the overflow chamber 50 as shown. A tubular cap 26*b* or other suitable plug is provided to cover the filling hole 24, although this is optional. It is preferred that the tubular cap 26*b* be configured for telescopic insertion into the filling hole 24, with a surrounding stopping flange 27 extending radially outward from a second end 29 of the tubular cap 26*b* to prevent insertion of said second end 29 into said filling hole 24. A portion of the tubular cap 26*b* extending from the stopping flange 27 is dimensionally configured for slidable, frictional engagement with defining edges 24*a* of the filling hole 24 to thereby inhibit the bubble solution from escaping through said filling hole 24.

One of the advantages of the overflow chamber 50 is that it prevents at least a portion of any bubble solution residing in the reservoir 20 from escaping through the solution feed holes 22 when the toy 10 is turned upside down, even in an absence of the partial vacuum effect. When the toy 10 is turned upside down, the bubble solution falls through the passage 52 into the overflow chamber 50. It is noted that the embodiment shown in FIG. 1B can be used with the plug 26*a* of FIG. 1 instead of the tubular cap 26*b*, or without any cap at all. When the toy 10 includes the overflow chamber 50 as in FIG. 1B, it is preferred to include an annular lip 54 extending radially inward into the reservoir 20 from a top portion of the walls 20*a* above the solution feed holes 22. The purpose of such an annular lip 54 is to inhibit the bubble solution from swirling up into the overflow chamber 50 during flight, and to direct the bubble solution out of the solution feed holes 22. The overflow chamber 50 is preferably conical as shown in FIG. 1B and thus more aerodynamically compatible for free flight.

If the tubular cap 27 is open at both opposing ends thereof, the advantages of solution retention are achieved without producing the partial vacuum effect. Thus, an open tubular cap 27 can be used with the toy 10 if it is desirable to prevent bubble solution from escaping from the filling hole 24, simultaneous with a faster release of solution from the solution feed holes 22 in the absence of the partial vacuum effect. It is noted that the cap 26*b* can be used with any embodiment of the invention.

Figure 2:
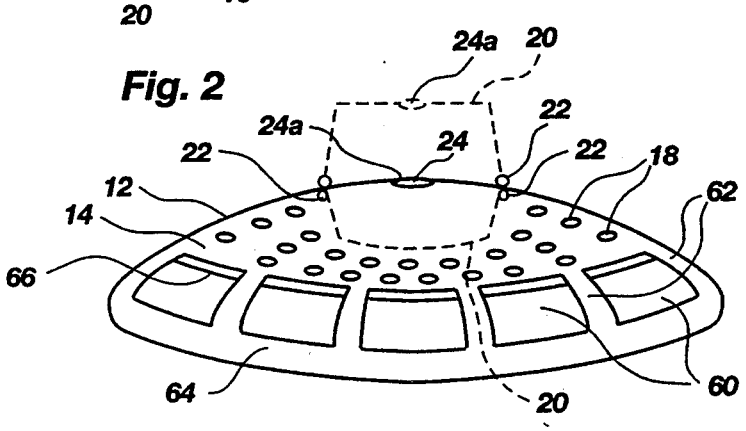
FIG. 2 illustrates a perspective view of an alternative embodiment of the flying bubble-producing toy of FIG. 1, including a catch rim and wider air-feed holes.

Additional features within the scope of the present invention are illustrated in the embodiment shown in FIG. 2. As noted above, the toy 10 results in substantially less bubble solution collecting undesirably on the upper surface 16. It is also noted that it is within the scope of the present invention to couple the reservoir 20 to the top surface 14 as shown in phantom line in FIG. 2, such that bubble solution spreads across said top surface through the solution feed holes 22. The advantage of the partial vacuum effect as discussed above can also be obtained with such a top-surface attachment of the reservoir 20. In any event or embodiment wherein bubble solution does collect on the upper surface 16, the excess will fall through large gaps 60, which also serve as replacements for the air feed holes 34. The formation of the large gaps 60 results in arcuate arms 62 extending radially outward from a perimeter of the body 12 and being intercoupled at distal ends to a base ring 64. It is preferable that the base ring 64 be substantially co-axial with an axis of rotation of the body 12. The large gaps 60 are sufficiently large to receive flow of bubble solution therethrough. The advantage of the embodiment of FIG. 2 is thus that the ring 64 and perhaps the arms 62 remain substantially free of bubble solution to thereby permit a user to grip the toy 10 without substantially touching the bubble solution. A solution-catching rim 66 is disposed on the lower surface 16 of the body 12, and preferably forms a complete circular member surrounding the bubble-forming apertures 18. The rim 66 is configured for blocking stray bubble solution which has spread beyond the apertures 18, to thereby inhibit said bubble solution from contacting the arcuate arms 62 and the ring 64.

Figure 3:
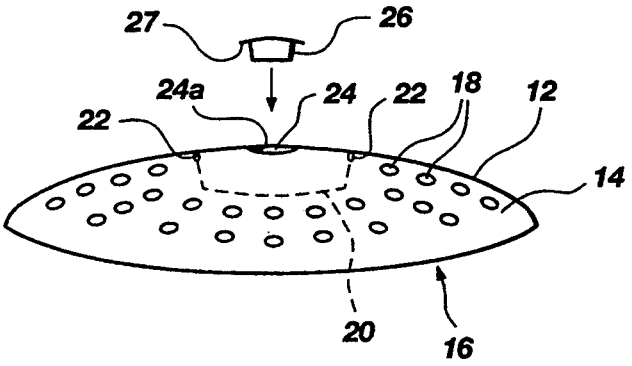
FIG. 3 illustrates a perspective view of an alternative embodiment of the flying bubble-producing toy of FIG. 1, without a perimeter rim or air-feed holes.

A further alternative embodiment in accordance with the present invention is illustrated in FIG. 3. This embodiment is similar to that of FIGS. 1 and 1A, without the surrounding rim 30. The absence of the surrounding rim 30 provides increased air currents as compared with the air feed holes 34 of FIGS. 1 and 1A.

Referring now to FIG. 4, it is noted that the leading edge 40 can be described as a surrounding edge extending from a perimeter of the body 12. It is preferred that the air feed holes 34 formed in the leading edge 40 of FIG. 4 be positioned such that central axes of said air feed holes 34 form an angle relative to central axes of the bubble-forming apertures 18, as is readily apparent from FIG. 4. This particular configuration results in air streams which are more effective in increasing and otherwise enhancing the formation and release of bubbles from the bubble-forming apertures 18.

It is noted that the surrounding rim 30 of FIGS. 1 and 1A can be described as extending from a perimeter of the body 12 and substantially defining a cylinder. When the air feed holes 34 are formed in the rim 30, a central axis of each feed hole 34 forms an angle relative to central axes of the bubble-forming apertures 18. The angle is preferably within a range of approximately seventy-five degrees to one hundred and five degrees, to thereby increase and enhance the formation and release of bubbles from the bubble-forming apertures 18.

The toy 10 is preferably made from ABS plastic as known in the art. It is preferred to attach the reservoir 20 to the body 12 by sonic welding, although this could be done with hot glue or some other method suitable for connecting plastics. It is preferred to fill the reservoir 20 with a soapy solution which is not irritable to the skin and which is otherwise noncaustic. The apertures 18 and the air feed holes 34 are preferably circular, but can alternatively be oval shaped, or any shape and size suitable for their purpose. Further, the toy 10 may include channel means for receiving bubble solution from the reservoir 20 and conveying said bubble solution across the lower surface and into the bubble-forming apertures 18. The phrase "channel means" shall be construed broadly to include grooves formed in the lower surface 16 between the solution feed holes 22 and the apertures 18, or tubular structure formed over the lower surface 16 to connect the holes 22 with the apertures 18, or the like.

The present invention represents a significant advance in the field of flying bubble-producing toys. The problems in the prior art noted above and others not discussed are overcome to a significant degree by the present invention. Those skilled in the art will appreciate from the preceding disclosure that the objectives stated above are advantageously achieved by the present invention.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A rotational glider toy configured for producing bubbles during free flight, said toy comprising:

a plate-like body having opposing upper and lower surfaces and at least one bubble-forming aperture formed to extend completely through said body, said at least one aperture being configured to hold bubble solution and release said solution in the form of at least one bubble when air passes through said aperture;

reservoir means disposed on the body and including a storage area for storing a supply of bubble solution and further including at least one solution feed hole which is disposed in communication with the storage area while having a dispensing opening positioned at the lower surface of the body at a location inward from the at least one bubble forming aperture thereby distributing said solution across the lower surface of the body and into said at least one bubble-forming aperture to thereby enable said apertures to hold and release said solution in the form of at least one bubble in response to rotation of the toy.

2. A glider toy as defined in claim 1, wherein the reservoir means comprises a reservoir structure being coupled to the lower surface of the body, said reservoir structure including at least one solution feed hole formed in a junction between said reservoir structure and said lower surface such that said at least one solution feed hole is in communication with the storage area, to thereby permit bubble solution residing in the storage area to be urged by centrifugal force through said at least one solution feed hole, across said lower surface of the body, and into said at least one bubble-forming aperture, in response to rotation of the toy.

3. A glider toy as defined in claim 2 wherein a portion of an inner surface of the reservoir structure leading to the at least one solution feed hole defines a conical section tapering outwardly toward said at least one solution feed hole to thereby assist the centrifugal force in urging the bubble solution through said at least one solution feed hole.

4. A glider toy as defined in claim 2 wherein the junction between the reservoir structure and the lower surface of the body defines a corner circle, and wherein said at least one solution feed hole comprises four solution feed holes positioned such that approximately one quarter arc-length of said corner circle separates each solution feed hole from its adjacent solution feed holes.

5. A glider toy as defined in claim 2 wherein the reservoir structure includes a filling hole formed therein to thereby permit bubble solution to be conveniently inserted into the storage area.

6. A glider toy as defined in claim 5, further comprising cap means configured for placement over the filling hole for inhibiting the bubble solution from escaping through the filling hole.

7. A glider toy as defined in claim 6, wherein the cap means comprises a plug configured for substantially closing off the filling hole such that only said at least one solution feed hole provides communication with the storage area, to thereby produce a partial vacuum in the storage area which operates to slow the speed by which the bubble solution is urged through said at least one solution feed hole.

8. A glider toy as defined in claim 6, wherein the cap means comprises an open tube having:

(i) a first open end configured for telescopic insertion into the filling hole, and an opposing second open end, and (ii) a surrounding stopping flange extending radially outward from said tube at the second end thereof and being configured for preventing insertion of said second open end into said filling hole, a portion of said tube extending from said stopping flange being dimensionally configured for slidable, frictional engagement with defining edges of the filling hole to thereby inhibit the bubble solution from escaping through the filling hole.

9. A glider toy as defined in claim 2, further comprising an overflow chamber substantially enclosing an overflow area and being coupled to the upper surface of the body, said overflow chamber being in communication with the storage area such that when the glider toy is turned upside down, at least a portion of any bubble solution residing in the storage area will fall into said overflow chamber and thereby be prevented from escaping through the solution feed holes.

10. A glider toy as defined in claim 9 wherein the overflow chamber includes a filling hole formed therein to thereby permit bubble solution to be conveniently inserted into the storage area.

11. A glider toy as defined in claim 10, further comprising cap means configured for placement over the filling hole, for inhibiting the bubble solution from escaping through the filling hole, wherein said cap means comprises an open tube having:

(i) a first open end configured for telescopic insertion into the filling hole, and an opposing second open end, and (ii) a surrounding stopping flange extending radially outward from said tube at the second end thereof and being configured for preventing insertion of said second open end into said filling hole, a portion of said tube extending from said stopping flange being dimensionally configured for slidable, frictional engagement with defining edges of the filling hole to thereby inhibit the bubble solution from escaping through the filling hole.

12. A glider toy as defined in claim 2 further comprising a surrounding edge extending from a perimeter of the body and including at least one air feed hole formed therein, each air feed hole having a central axis which forms an angle relative to central axes of said at least one bubble-forming aperture, to thereby cause air to pass through said at least one air feed hole in response to rotation of the toy to increase the formation and release of bubbles from said at least one or more bubble-forming aperture.

13. A glider toy as defined in claim 2 wherein the body is substantially circular, said glider toy further comprising a surrounding rim extending from a perimeter of the body and substantially defining a cylinder, said rim including at least one air feed hole formed therein, each air feed hole having a central axis which forms an angle relative to central axes of said at least one bubble-forming aperture, said angle being within the range of approximately seventy-five degrees to one hundred and five degrees, to thereby cause air to pass through said at least one air feed hole in response to rotation of the toy to increase the formation and release of bubbles from said at least one bubble-forming aperture.

14. A glider toy as defined in claim 1 wherein the plate-like body comprises a substantially rigid, concavo-convex member to thereby enable air to pass through the bubble-forming apertures during free flight of the toy regardless of whether the toy is rising or falling.

15. A glider toy as defined in claim 1 wherein the upper surface of the body is substantially smooth, and wherein the reservoir means includes channel means for receiving bubble solution from a reservoir and for conveying said bubble solution across the lower surface and into said one or more bubble forming apertures.

16. A glider toy as defined in claim 1 wherein the plate-like body is substantially circular and includes a plurality of arcuate arms extending radially outward from a perimeter thereof, said arcuate arms being intercoupled at distal ends to a ring and having substantial spacing therebetween such that said ring is substantially co-axial with an axis of rotation of said body, said spacing between the arms and ring being sufficient to receive flow of solution therethrough such that the ring remains substantially free of bubble solution to thereby permit a user to grip the toy without substantially touching bubble solution.

17. A glider toy as defined in claim 16 further comprising a solution-catching rim disposed on the lower surface of the body near said perimeter, said rim being configured for blocking bubble solution which has spread across the lower surface of the body to thereby inhibit said bubble solution from contacting the arcuate arms and the ring.

* * * * *